US010005642B2

(12) United States Patent
Valjus et al.

(10) Patent No.: US 10,005,642 B2
(45) Date of Patent: Jun. 26, 2018

(54) ELEVATOR AND ELEVATOR ROPE

(71) Applicant: KONE CORPORATION, Helsinki (FI)

(72) Inventors: Petteri Valjus, Helsinki (FI); Raimo Pelto-Huikko, Vantaa (FI); Riku Lampinen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 0 days. days.

(21) Appl. No.: 14/175,084

(22) Filed: Feb. 7, 2014

(65) Prior Publication Data

US 2014/0224592 A1 Aug. 14, 2014

(30) Foreign Application Priority Data

Feb. 14, 2013 (EP) ..... 13155228

(51) Int. Cl.
*B66B 7/06* (2006.01)
*B66B 11/00* (2006.01)

(52) U.S. Cl.
CPC ..... *B66B 7/062* (2013.01); *B66B 11/008* (2013.01); *B66B 11/0045* (2013.01)

(58) Field of Classification Search
CPC ..... B66B 11/008; B66B 11/009; B66B 7/062; F16G 1/16; F16G 1/08; F16G 1/12
USPC ..... 187/254, 255, 266
See application file for complete search history.

(56) References Cited

U.S. PATENT DOCUMENTS

| | | | | |
|---|---|---|---|---|
| 2,107,013 | A * | 2/1938 | Morgan | 474/252 |
| 2,526,324 | A * | 10/1950 | Bloomfield | 474/270 |
| 5,899,301 | A * | 5/1999 | Aulanko et al. | 187/254 |
| 6,247,557 | B1 * | 6/2001 | Kobayashi | B66B 11/008 187/251 |
| 6,364,061 | B2 * | 4/2002 | Baranda et al. | 187/266 |
| 6,397,974 | B1 * | 6/2002 | Adifon | B66B 11/0438 187/254 |
| 6,419,605 | B1 * | 7/2002 | Takahashi et al. | 474/237 |

(Continued)

FOREIGN PATENT DOCUMENTS

| | | | |
|---|---|---|---|
| CN | 1233583 | A | 11/1999 |
| CN | 1324322 | A | 11/2001 |

(Continued)

*Primary Examiner* — Michael A Riegelman
(74) *Attorney, Agent, or Firm* — Birch, Stewart, Kolasch & Birch, LLP

(57) ABSTRACT

An elevator includes a hoistway, an elevator car and a counterweight vertically movable in the hoistway, a drive machine including a drive sheave, a roping including one or more ropes between the elevator car and the counterweight and passing around the drive sheave and suspending the elevator car and the counterweight. The drive sheave is positioned in the hoistway space between a hoistway wall and the vertical projection of the car, the drive sheave rotation plane being at least substantially parallel to the hoistway wall. The rope(s) is/are belt-like, each including at least one force transmission parts for transmitting force in the longitudinal direction of the rope, which force transmission part is made of composite material including reinforcing fibers in a polymer matrix. The reinforcing fibers are carbon fibers, and the force transmission part has width larger than thickness thereof as measured in width-direction of the rope.

14 Claims, 4 Drawing Sheets

(56) References Cited

U.S. PATENT DOCUMENTS

| | | | | |
|---|---|---|---|---|
| 6,471,012 | B2 * | 10/2002 | Faletto | B66B 11/008 187/256 |
| 6,742,769 | B2 * | 6/2004 | Baranda et al. | 254/390 |
| 7,165,653 | B2 * | 1/2007 | Rennetaud | 187/254 |
| 7,549,514 | B2 * | 6/2009 | Heggli | B66B 7/021 187/256 |
| 7,748,501 | B2 * | 7/2010 | Marler | B66B 7/062 187/251 |
| 7,757,818 | B2 * | 7/2010 | Fischer | 187/254 |
| 7,806,238 | B2 * | 10/2010 | Fischer | B66B 11/008 187/251 |
| 7,874,404 | B1 * | 1/2011 | Adams et al. | 187/406 |
| 8,157,058 | B2 * | 4/2012 | Ach | 187/251 |
| 2003/0057031 | A1 * | 3/2003 | Gottlieb et al. | 187/394 |
| 2004/0110441 | A1 * | 6/2004 | Parrini | 442/181 |
| 2005/0217943 | A1 | 10/2005 | Heggli et al. | |
| 2005/0284705 | A1 * | 12/2005 | Aulanko et al. | 187/266 |
| 2006/0175149 | A1 * | 8/2006 | Det | B66B 7/027 187/406 |
| 2009/0166132 | A1 * | 7/2009 | Ach | 187/254 |
| 2011/0000746 | A1 * | 1/2011 | Pelto-Huikko et al. | 187/254 |
| 2011/0259677 | A1 | 10/2011 | Dudde et al. | |
| 2013/0048432 | A1 * | 2/2013 | Alasentie | 187/251 |

FOREIGN PATENT DOCUMENTS

| | | | | |
|---|---|---|---|---|
| DE | 102008037541 | A1 * | 10/2009 | B66B 7/06 |
| EP | 0631967 | A2 | 1/1995 | |
| EP | 0957061 | A1 | 11/1999 | |
| EP | 1396458 | A2 * | 3/2004 | B66B 7/06 |
| EP | 1555233 | A1 * | 7/2005 | B66B 7/06 |
| EP | 1 640 307 | A2 | 3/2006 | |
| WO | WO 03/062117 | A1 | 7/2003 | |
| WO | WO 2009026730 | A1 * | 3/2009 | D07B 1/16 |
| WO | WO 2009090299 | A1 * | 7/2009 | B66B 7/06 |
| WO | WO 2011/148033 | A1 | 12/2011 | |

* cited by examiner

ELEVATOR AND ELEVATOR ROPE

FIELD OF THE INVENTION

The invention relates to an elevator. The elevator is particularly meant for transporting passengers and/or goods.

BACKGROUND OF THE INVENTION

Modern elevators usually have a drive machine which drives the elevator car under control of an elevator control system. The drive machine typically comprises a motor and a drive sheave engaging an elevator roping which is connected to the car. Thus, the driving force is transmitted from the motor to the car via the roping. There are elevators which do not have a special machine room for accommodating the drive machine. These elevators may be of the type where the drive machine is positioned in the elevator hoistway, i.e. to the same space where the elevator car and possibly also the counterweight of the elevator moves. In this type of elevators the problem is that the hoisting function, i.e. the drive machine, the counterweight and the roping and other related components, must be fitted so that a great number of various preferences are met at the same time. To mention some preferred features, the elevator should have a low head space and large car cross-sectional area, yet small hoistway cross-sectional area. The car should be as centrally suspended as possible, and the suspension should be safe. In particular, the engagement between ropes and the drive sheave should be reliable. Furthermore, each component and the elevator in total should be economical to manufacture. Many of the requirements for an elevator affect each other and compromising is necessary. When the elevator is to be made machine-roomless the space requirements become especially challenging. There are prior art elevators where one or several of these problems have been solved by placing the drive machine and the drive sheave in the hoistway space which is between the hoistway wall and the vertical projection of the car. Among other benefits, in this way the hoistway head space can be made low. This solution, however, has the effect of reducing the cross sectional space of the car (when the elevator is installed in a hoistway of a certain size). Especially, the size of the machinery and the size of the rope bundle passing back and forth in the hoistway consumes some room between the car and the hoistway wall. This type of elevator is shown for instance in document EP0957061A1. Even though this type of elevator may at its best reach high level of space efficiency, even better space efficiency is desirable. In the elevators of prior art as described above, it is typical to use a roping, which has a great number of metallic force transmission parts in the form of twisted steel wire ropes, for transmitting force in the longitudinal direction of the rope. In prior art, because of the space requirements the ropes have been made with radius allowing space efficient turning of the ropes. So as to have at the same time a reasonable maximum load for the elevator, the rope number has been selected great. Thus, the space efficiency gained in radial direction has increased the size of the rope bundle in width direction. Taking into account the above mentioned, there is a need for even more space efficient elevator with a good maximum load.

BRIEF DESCRIPTION OF THE INVENTION

The object of the invention is, inter alia, to solve previously described drawbacks of known solutions and problems discussed later in the description of the invention. The object of the invention is to introduce a space-efficient elevator, in particular an elevator where cross-sectional area needed for the hoisting function is minimized. Especially, the object is to reduce the space needed between the elevator car and hoistway wall. This leads to increased car cross-sectional area in a certain size hoistway. An object of the invention is to achieve these benefits with minimal compromises in several other properties of the elevator. Embodiments are presented, inter alia, where the object of space efficiency is achieved with low head space yet the motor of the drive machine having freedom for great radial dimensions and therefore good potential for torque production.

It is brought forward a new elevator, which comprises a hoistway, an elevator car and a counterweight vertically movable in the hoistway, a drive machine comprising a drive sheave, a roping comprising one or more ropes between the elevator car and the counterweight and passing around the drive sheave and suspending the elevator car and the counterweight, wherein the drive sheave is positioned in the hoistway space which is between a hoistway wall and the vertical projection of the car the drive sheave rotation plane being at least substantially parallel to the hoistway wall. Said rope(s) is/are belt-like, each comprising one force transmission part or a plurality of force transmission parts for transmitting force in the longitudinal direction of the rope, which force transmission part(s) is/are made of composite material comprising reinforcing fibers in a polymer matrix, an in that the reinforcing fibers are carbon fibers, and in that said one force transmission part or each of said plurality of force transmission parts has width larger than thickness thereof as measured in width-direction of the rope. In this way a very space efficient elevator is achieved. In particular, the cross section of individual ropes and the overall space required by the rope bundle and the drive sheave are effectively utilized. Furthermore, also the longitudinal force transmission capabilities of the roping are good. In this way the elevator maximal load is good despite the very compact hoisting function.

In a preferred embodiment the of the elevator the roping comprises exactly two of said ropes passing around the drive sheave adjacent each other in width-direction of the rope the wide sides of the ropes against the drive sheave. Thus, the ropes are wide and the number of ropes is small, which minimizes non-bearing clearances between adjacent ropes. Accordingly, the width of the individual ropes and the overall space required by the rope bundle is utilized very effectively for load bearing function. As a result, the surface of the drive sheave can be effectively utilized with minimal non-utilized surface areas and the drive sheave can be made very small in its axial direction. Thus, it will fit well in the aforementioned space even when this space is very slim. Having two ropes facilitates safety of the elevator as in this way it is not relied on only one rope.

In a preferred embodiment the of the elevator said the width/thickness ratio(s) of said force transmission part(s) is/are at least 8, preferably more. With the ratio as specified, the aforementioned benefits are strongly present.

In a preferred embodiment the of the elevator the width/thickness ratio of said rope(s) is/are at least 4, preferably more. With the ratio as specified, the aforementioned benefits are strongly present.

In a preferred embodiment the of the elevator the thickness of each of said force transmission part(s) is from 0.8 mm to 1.5 mm, preferably from 1 mm to 1.2 mm as measured in thickness direction of the rope. In this way, the roping as specified above, will have an optimal combination of properties with regard to compactness, traction abilities and tensile properties in case of an elevator where the traction sheave is positioned as specified above. Preferably, the width of the of the single force transmission part or the total width of the two force transmission parts of the same rope is from 20 mm to 30 mm. Preferably, the total width of the force transmission parts of the two ropes is 40-60 mm. This is the optimal combination of dimensions for obtaining an elevator with high maximum load and space efficiency.

In a preferred embodiment the of the elevator said rope(s) is/are connected on the first side of the drive sheave to the car via a at least one diverting wheel mounted on the car and on second side of the drive sheave to the counterweight via a at least one diverting wheel mounted on the counterweight. In this way, the roping is easy to guide to pass around the drive sheave positioned as defined above. Additionally, high suspension ratio facilitates compactness of the drive machine. Preferably, said at least one diverting wheel mounted on the car guides the rope(s) arriving down from the drive sheave to pass under the car and upwards to a rope fixing point. In this way, at least somewhat central suspension can be achieved. Said diverting wheels are preferably mounted at the bottom part of the car. Thus, the distance between the diverting wheels and drive sheave is long enough to considerably reduce the sensitivity for fractures in the composite parts caused by twisting of the rope.

In a preferred embodiment the of the elevator each of said rope(s) comprise exactly one of said force transmission parts. Thus, non-bearing areas between adjacent force transmission parts are minimized.

In a preferred embodiment the of the elevator each of said rope(s) comprise exactly two of said force transmission parts adjacent in width-direction of the rope. Thus, non-bearing areas between adjacent force transmission parts are minimized, yet not having to rely on only one force transmitting part. Said two force transmission parts are parallel in length direction of the rope and placed on the same plane in width-direction of the rope.

In a preferred embodiment the elevator comprises a car guide rail between the car and the hoistway wall and the drive sheave is positioned between hoistway wall and the guide rail. With this kind of arrangement the extremely compact size of the overall structure of drive sheave and the roping make possible extremely efficient utilization of space in all directions. At the same time it is provided a reliable base for mounting the drive sheave.

In a preferred embodiment the drive sheave is fixed rotatably to the car guide rail. Preferably, the drive sheave is fixed rotatably to the car guide rail via a frame of the motor for rotating the drive sheave.

In a preferred embodiment the motor of the drive machine is a flat electric motor in its axial direction, its greatest axial dimensions being substantially smaller than its greatest radial dimensions. Extending the flat motor size radially can increase its torque potential. Thus, the machine torque potential of the elevator may be adjusted suitable simply without problems with space efficiency.

In a preferred embodiment the drive machine comprises an electric motor for rotating the drive sheave, and the motor is positioned in said hoistway space which is between a hoistway wall and the vertical projection of the car, the plane of rotation of the motor being parallel to the plane of rotation of the drive sheave. Preferably, they are coaxial. This facilitates a very compact and simple machine structure especially if the motor is of flat construction. Preferably, the drive sheave is an extension of the rotor of the motor of the drive machine.

In a preferred embodiment the of the elevator the drive sheave rope contacting circumference has diameter from 250 mm to 350 mm.

In a preferred embodiment each of said rope(s) has at least one contoured side provided with guide rib(s) and guide groove(s) oriented in the longitudinal direction of the rope said contoured side being fitted to pass against a contoured circumference of the drive sheave said circumference being provided with guide rib(s) and guide groove(s) so that said contoured circumference forms a counterpart for said contoured side(s) of the rope(s).

Thus, the wandering of the ropes is small which facilitates that small distances between adjacent ropes can be had very small as well as running clearances between the ropes and the stationary parts of the machinery. Preferably, the rope(s) comprise a polymer layer forming said ribs and grooves of the rope(s).

In a preferred embodiment the module of elasticity (E) of the polymer matrix is over 2 GPa, most preferably over 2.5 GPa, yet more preferably in the range 2.5-10 GPa, most preferably of all in the range 2.5-3.5 GPa. In this way a structure is achieved wherein the matrix essentially supports the reinforcing fibers, in particular from buckling. One advantage, among others, is a longer service life.

In a preferred embodiment each of said rope(s) has a wide and flat side without guide ribs or guide grooves fitted to pass against a cambered circumference of the drive sheave.

In a preferred embodiment the force transmission part(s) of the rope cover(s) majority, preferably 60% or over, more preferably 65% or over, more preferably 70% or over, more preferably 75% or over, most preferably 80% or over, most preferably 85% or over, of the width of the rope. In this way at least majority of the width of the rope will be effectively utilized and the rope can be formed to be light and thin in the bending direction for reducing the bending resistance.

In a preferred embodiment the reinforcing fibers are oriented in the lengthwise direction of the rope substantially untwisted relative to each other. The fibers are thus aligned with the force when the rope is pulled, which facilitates good rigidity under tension. Also, behaviour during bending is advantageous as the force transmitting parts retain their structure during bending. The wear life of the rope is, for instance long because no chafing takes place inside the rope. Preferably, individual reinforcing fibers are homogeneously distributed in said polymer matrix. Preferably, over 50% of the cross-sectional square area of the load-bearing part consists of said reinforcing fiber. Preferably, the load-bearing part(s) cover(s) a over proportion 50% of the cross-section of the rope.

The elevator as describe anywhere above is preferably, but not necessarily, installed inside a building. The car is preferably arranged to serve two or more landings. The car preferably responds to calls from landing and/or destination commands from inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

DETAILED DESCRIPTION

Figure 1:
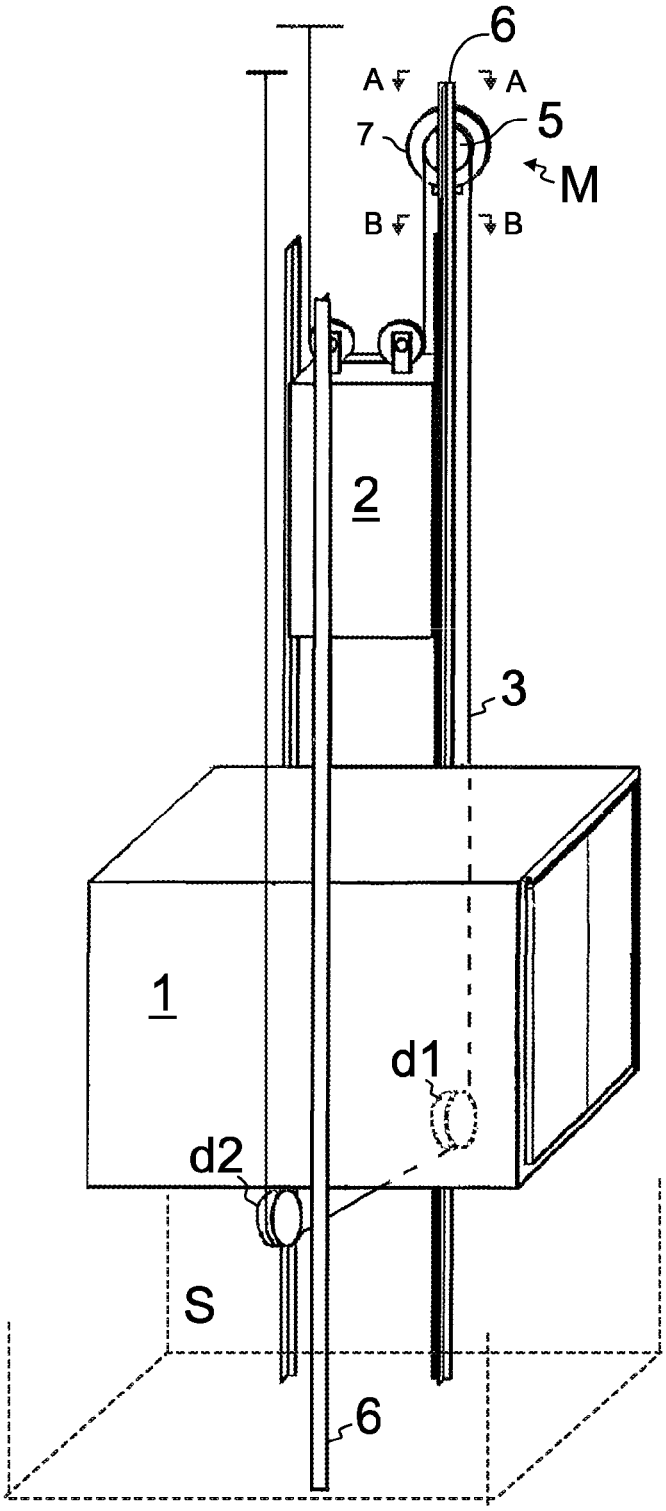
FIG. 1 illustrates schematically an elevator according to an embodiment of the invention.
Figure 2A:
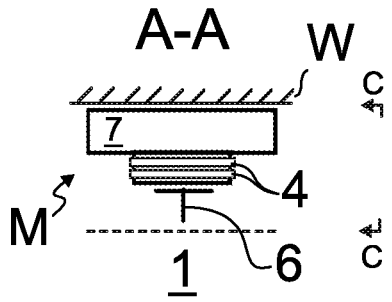
FIGS. 2*a*-2*b* illustrate views A-A and B-B of FIG. 1.
Figure 2B:
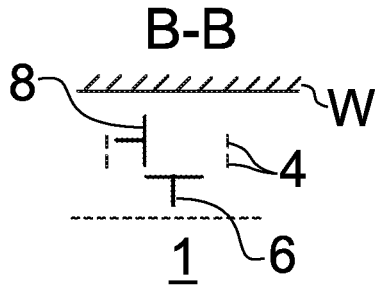
Figure 2C:
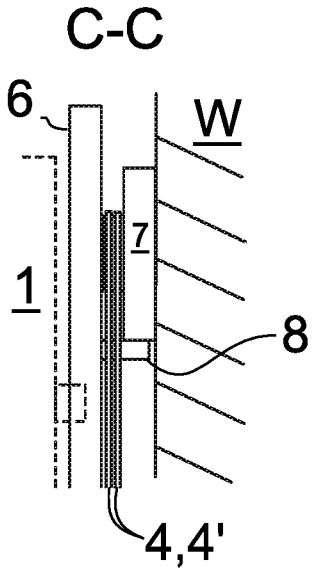
FIG. 2*c* illustrates view C-C of FIG. 1.

FIGS. 1 and 2 illustrate an elevator according to a preferred embodiment. The elevator comprises a hoistway S, an elevator car 1 and a counterweight 2 vertically movable in the hoistway S, and a drive machine M which drives the elevator car under control of an elevator control system (not shown). The drive machine M is located in the top part of the hoistway S. It comprises a motor 7 and a drive sheave 5 engaging an elevator roping 3, which is connected to the car 1. Thus, driving force can be transmitted from the motor to the car 1 via the drive sheave 5 and the roping 3. The roping 3 passes around the drive sheave 5 and suspends the elevator car 1 and the counterweight 2 and comprises ropes 4,4' connecting the elevator car 1 and the counterweight 2. The drive sheave 5 is positioned in the hoistway space which is between the hoistway wall W and the vertical projection of the car 1 the drive sheave rotation plane being parallel to the hoistway wall W. In this way the drive sheave 5 is outside from the path of the car. Thus, the drive sheave 5 does not form an obstacle for the car and does not limit the head space of the elevator. For the same reasons, and as also illustrated if FIGS. 1-2, it is preferable that the motor 7 is in this space which is between the hoistway wall W and the vertical projection of the car 1 as well.

Because the rotation plane of the sheave 5 is in this elevator parallel to the hoistway wall, the axis of the rotation of the sheave 5 is orthogonal to the wall, and the width of the rope bundle, the axial size of the drive sheave, and the size of the motor are important factors defining the minimal distance between car wall and the hoistway wall. The car wall is also parallel to the hoistway wall W. The ropes 4,4' are belt-like, and they each comprise(s) force transmission part(s) 15 for transmitting force in the longitudinal direction of the rope 4,4'. In particular, each rope 4, 4' comprises one force transmission part 15 or a plurality of force transmission parts 15 adjacent each other in width-direction of the rope 4,4'. In this way the space consumption of the drive sheave 5 and the ropes 4,4' is reduced. The ropes being belt-like they have a width greater than the thickness. The ropes 4,4' pass around the drive sheave 5 bending around an axis that is in the width direction of the ropes 4,4' and the force transmitting parts 15 thereof. In the disclosed elevator the contact surface is designed large so the traction can be ensured by this large contact surface. In this way, also the motor size is kept reasonable as the drive sheave radius can be kept reasonable due to the reasonable turning radius of the ropes which follows the belt-like form. In the preferred embodiment, the ropes 4, 4' and the drive sheave 5 are placed in the space between car 1 and hoistway wall W such that the drive sheave rotation plane is at least substantially parallel to the hoistway wall W. This means that the belts 4,4' pass such that their large dimensions are in the direction in which the space consumption needs to be minimized. This is compensated for by designing the roping 3 such that the bearing cross section of the rope bundle and inner structure of its each rope is maximized. Said one force transmission part 15 or each of said plurality of force transmission parts 15 has width w, w' substantially larger than thickness t, t' thereof as measured in width-direction of the rope 4,4'. This means that each force transmission part 15 is constructed wide. Due to this, small number of force transmission parts can be used, thus minimizing non-bearing areas between adjacent force transmission parts 15. Accordingly, the width of each rope 4, 4' is utilized very effectively for load bearing function. Furthermore, ropes are made wide and the number of ropes small, which minimizes the number of non-bearing clearances between adjacent ropes 4, 4' of the roping 3. Accordingly, the total amount of non-bearing areas inside the roping is minimized. The force transmission parts 15 are preferably made of composite material comprising reinforcing fibers f in a polymer matrix m, the reinforcing fibers being carbon fibers. In this way the force transmission parts 15 can be made to have a very high tensile stiffness and tensile strength per unit area of cross section. To achieve a certain tensile strength and rigidity a bearing cross-sectional area is sufficient in case of carbon fiber composite, which is half of the cross-sectional area typically needed with metallic ropes. Thus, space consumption of the drive sheave and the ropes in the width direction of the rope (which direction corresponds to axial direction of the drive sheave and the direction between the hoistway wall and car) can be reduced even to less than 50 mm, yet the hoisting capacity is high. The preferred inner structure of the rope is preferably constructed as will be later described.

The suspension ratio is preferably 2:1, which is also the case in the preferred embodiment. High suspension ratio facilitates compactness of the drive machine, in particular the motor thereof, because in this way the motor 7 of the drive machine M can have a high rpm. The suspension ratio could alternatively be 1:1 or 4:1. As illustrated in FIG. 1, the suspension is preferably arranged such that the ropes 4,4' are connected on the first side of the drive sheave 5 to the car 1 via a at least diverting wheels d1 and d2 mounted on the car 1 and on second side of the drive sheave 5 to the counterweight 2 via a at least one diverting wheel mounted on the counterweight 2. In the preferred embodiment, the hoisting ropes are routed such that said at least one diverting wheel mounted on the car 1 guide the ropes arriving down from the drive sheave under the car 1 and upwards to a rope fixing point. In this way, the suspension of the car can be made central or at least close to central. In the preferred embodiment, the ropes 4,4' underloop the car in skewed configuration. The diverting wheel to which the ropes 4,4' arrive from the drive sheave 5 has rotation axis which is in substantially less than 90 degrees angle relative to rotation axis of the drive sheave 5, such that each of rope ropes 4,4' turn between the drive sheave 5 and said diverting wheel d1 around its longitudinal axis substantially less than 90 degrees. In this way, routing of each belt and its each force transmitting part 15 under the car 1 is gentle and less sensitive for causing fractures in the composite force transmitting part(s) 15.

On the counterweight side, the ropes 4,4' pass down from the drive sheave 5 to the diverting pulley(s) of the counterweight 2 and around them turning in opposite bending direction than on the drive sheave 5, and from the diverting pulley(s) further upwards to the fixing point. In this embodiment, the elevator is 2:1 and both ends of the ropes are fixed to a stationary elevator structure, in this case preferably to a rigid structure fixed on the guide rail(s) 6 or alternatively to the hoistway ceiling.

As also referred earlier, the elevator comprises preferably car guide rails 6 for guiding the car movement. Preferably, the elevator comprises a car guide rail 6 in the aforementioned hoistway space which is between the car 1 and the hoistway wall W and the drive sheave 5 is positioned between hoistway wall W and the guide rail 6.

The elevator comprises a first car guide rail 6 on a first side of the elevator car 1 and a second car guide rail 6 on a second, opposite side, guided by which car guide rails the elevator car 1 is arranged to move. For this purpose the elevator car 1 comprises a guide (such as a guide shoe or guide roller) traveling guided by the first guide rail, as well as a guide (such as a guide shoe or guide roller) traveling guided by the second guide rail, which guides can be according to any prior art. The elevator comprises a counterweight, which is arranged to travel on the first side of the elevator car, on the side of which side is the first car guide rail and also the drive sheave 5. In this case, the hoisting roping 3 travels from its fixing point to the counterweight, passes around the diverting pulley(s) in connection with it and rises up to the traction sheave 5, passes over the traction sheave 5 and descends to the elevator car 1 to the first diverting pulley d1. The ropes 4,4' travel onwards below the inside space I of the car to the second diverting pulley d2, from where onwards upwards to its fixing point beside the second side of the elevator car 1, on the side of which side is the second car guide rail. It is preferable that the circumference of said first diverting pulley d1 extends to outside the vertical projection of the elevator car 1 on the first side of the elevator car 1, and the rim of said second diverting pulley d2 extends to outside the vertical projection of the elevator car on the second side of the elevator car 1. Thus, the ropes 4,4' can travel beside the car. In the preferred embodiment, the configuration is skewed so the hoisting ropes between the first diverting pulley d1 and second diverting pulley d2 cross the line between the guide rails 6. It is to be noted that the ropes 4,4' could be also routed in alternative routes.

The force transmitting part(s) of the ropes 4,4' being of composite material as specified above, the ropes suit well also for reverse-bending. Thus, the ropes 4,4' can be guided to pass with a great contact angle around the drive sheave 5 also in cases where suspension-ratio is 2:1 or 4:1. This is because the ropes can bend in either direction and therefore be routed freely around diverting wheels and the ropes can pass straight down from the drive sheave on both sides thereof. A great contact angle leads to benefit that the engagement between the drive sheave 5 and the ropes 4,4' can be based on friction, and positive connection, such as with toothed belts, is not necessary.

The roping 3 comprises ropes 4,4' passing around the drive sheave 5 adjacent each other in width-direction of the rope 4,4' the wide sides of the ropes 4,4' against the drive sheave 5. It is preferable that the roping 3 comprises exactly two (only two, not more) ropes 4,4' passing around the drive sheave 5 adjacent each other in width-direction of the rope 4,4' the wide sides of the ropes 4,4' against the drive sheave. The size of the ropes is minimized by utilizing their width efficiently with wide force transmitting part and using composite material. Individual belt-like ropes and the bundle they form can in this way be formed surprisingly compact.

It is preferable that the motor 7 is a flat electric motor in its axial direction, its greatest axial dimensions being substantially smaller than its greatest radial dimensions. Furthermore, the greatest axial dimensions of the motor and the drive sheave 5 together are substantially smaller than the greatest axial dimensions of the motor and the drive sheave 5 together. Different motors flat in its axial direction are known. Especially, a permanent-magnet motor can be made very flat. The flat motor may be an axial flux motor, in which the air gap between the stator and the rotor is essentially in the direction of the axis of rotation of the rotor, but it can alternatively be a radial flux motor, in which the air gap between the stator and the rotor is essentially in the direction of the radius of the electric motor. Extending the flat motor size radially can increase its torque potential. Thus, its torque potential may be adjusted suitable simply without problems with space efficiency. In the case of the elevator as specified where the rotation plane of the drive sheave is parallel to the hoistway wall W, extending the motor size radially is not very harmful for the space efficiency as in this direction extending the motor radially does not consume directly the space reserved for the path of the car 1. In the preferred embodiment, the motor 7 is positioned also in said hoistway space which is between a hoistway wall W and the vertical projection of the car 1 the drive sheave rotation plane being at least substantially parallel to the hoistway wall W. In the preferred embodiment, its axis of rotation is parallel with the axis of rotation of the drive sheave 5, in particular these axis being coaxial. This is achieved such that the drive sheave 5 is an extension of the rotor of the motor 7 of the drive machine M. The drive sheave 5 is integral with the rotor of the motor 7 of the drive machine M. In the preferred embodiment, the drive sheave 5 is fixed rotatably to the car guide rail 6, in particular on the back side thereof. In this way, the fixing point is easy to arrange independent of the hoistway material or interfaces. This point also provides a rigid and reliable support, and ensures correct positioning simply.

The drive sheave 5 is fixed rotatably to its fixing point, i.e. to the car guide rail 6 in this case, via a frame 8 of the motor 7 for rotating the drive sheave 5. Alternatively or additionally the drive sheave could be fixed rotatably via the frame 8 to the wall W. Alternatively, the drive sheave could be fixed rotatably on top of the guide rail 6.

Figure 3A:
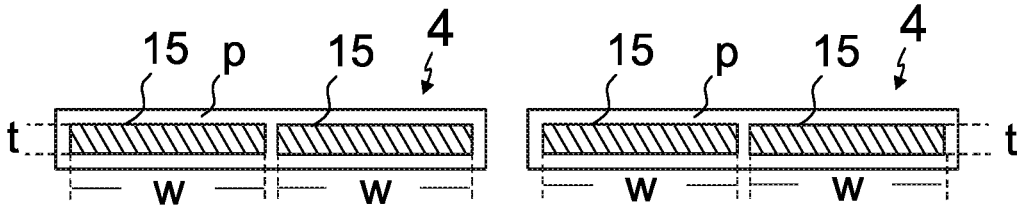
FIGS. 3*a* and 3*b* illustrate preferred alternative structures of the rope.
Figure 3B:
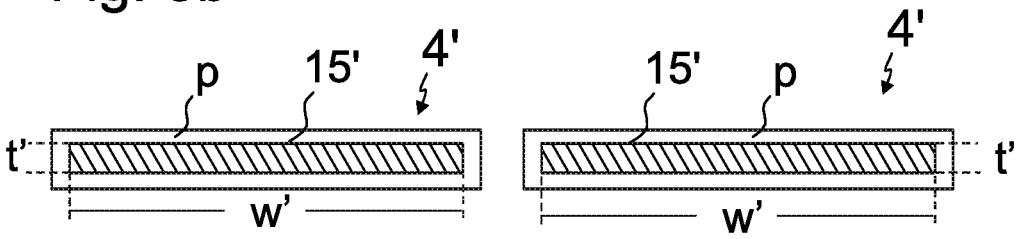

FIGS. 3*a* and 3*b* disclose preferred cross-sectional structures for the ropes 4,4' as well as their preferred configuration relative to each other in the roping 3. In these cases, the roping comprises only these two ropes 4,4'. The rope 4 as illustrated in FIG. 3*b* comprises one force transmission part 15 for transmitting force in the longitudinal direction of the rope 4 and the rope 4' as illustrated in FIG. 3*a* comprises a plurality of force transmission parts 15 for transmitting force in the longitudinal direction of the rope 4'. The preferred internal structure for the force transmission part(s) 15 is disclosed elsewhere in this application, in particular in connection with FIG. 4.

The force transmission parts 15 of each rope is/are surrounded with a layer p, which is preferably of polymer, most preferably of polyurethane, which layer p forms the surface of the rope 4,4'. In this way, it provides the surface for contacting the drive sheave. Also, in this way, its frictional properties and protecting properties are good. For facilitating the formation of the force transmission part 15 and for achieving constant properties in the longitudinal direction it is preferred that the structure of the force transmission part 15 continues essentially the same for the whole length of the rope 4,4'. For the same reasons, the structure of the rope 4,4' continues preferably essentially the same for the whole length of the rope 4,4'.

As mentioned, the ropes 4,4' are belt-shaped. The width/thickness ratio of each rope is preferably at least at least 4, even more preferably at least 5 or more, yet even more preferably at least 6, yet even more preferably at least 7 or more, yet even more preferably at least 8 or more, most preferably of all more than 10. In this way a large cross-sectional area for the rope is achieved, the bending capacity of the thickness direction of which is good around the axis of the width direction also with rigid materials of the force transmission part. However, the width should not be excessive.

The aforementioned force transmission part 15 or a plurality of force transmission parts 15 together cover most, preferably 80% or more, of the width of the cross-section of the rope for essentially the whole length of the rope. Thus the supporting capacity of the rope with respect to its total lateral dimensions is good, and the rope does not need to be formed to be thick. This can be simply implemented with the composite as specified above and this is particularly advantageous from the standpoint of, among other things, service life and bending rigidity.

The ropes 4 of FIG. 3*a* comprise each two force transmission parts 15 of the aforementioned type adjacent in width-direction of the rope 4,4'. They are parallel in longitudinal direction and on essentially the same plane relative to each other. Thus the resistance to bending in their thickness direction is small. The force transmission parts 15 are in one suitable example of this configuration each 1.1 mm thick as measured in thickness direction of the rope 4, and 12 mm wide as measured in width direction of the rope.

The ropes 4' of FIG. 3*b* comprise each only one force transmission part 15 of the aforementioned type. The force transmission parts 15 are in one suitable example of this configuration each 1.1 mm thick as measured in thickness direction of the rope 4, and 25 mm wide as measured in width direction of the rope.

As mentioned earlier, the force transmission part(s) 15 have/has width (w,w') larger than thickness (t,t') thereof as measured in width-direction of the rope 4,4'. In particular, the width/thickness ratio(s) of each of said force transmission part(s) 15 is/are at least 8, preferably more. In this way a large cross-sectional area for the force transmission part/parts is achieved, without weakening the bending capacity around an axis extending in the width direction. So as to achieve an extremely compact and yet working solution for an elevator the thickness t,t' of each of said force transmission part(s) 15 is from 0.8 mm to 1.5 mm, preferably from 1 mm to 1.2 mm as measured in thickness direction of the rope 4,4'. The width w' of the of the single force transmission part 15 or the total width w+w of the two force transmission parts 15 of the same rope 4,4' is not more than 30 mm, preferably from 20 mm to 30 mm. In this way the rope is made very small in all directions and it will fit to very small space to bend in reasonable radius. The total width (w+w+w+w, w'+w') of the of the force transmission parts 15 of the ropes 4,4' of the roping 3 is 40-60 mm. In this way the width of the rope bundle can be even smaller than what is achieved with metal ropes, yet the tensile strength and rigidity properties of the roping is at same level and the bending radius is not too great for producing torque in compact manner. There are two ropes, thus making the roping 3 safer not relying on merely one larger rope. In this way, more redundant roping is obtained.

Figure 4:
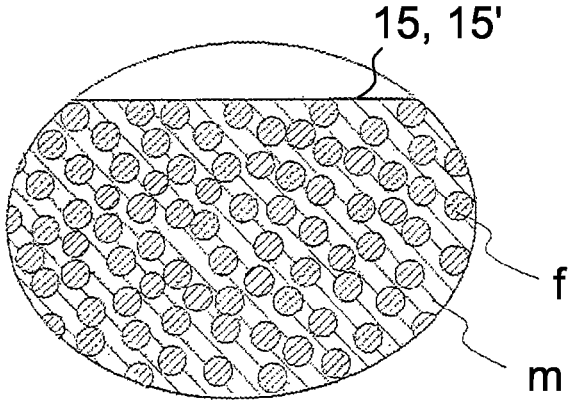
FIG. 4 illustrates a preferred internal structure for the force transmission part.

The bending direction of the rope is around an axis that is in the width direction of the rope and also in width direction of the force transmitting parts thereof (up or down in the FIGS. 3*a* and 3*b*). The inner structure of the force transmitting part 15 is more specifically as follows. The inner structure of the force transmitting part 15 is illustrated in FIG. 4. The force transmitting part 15 with its fibers is longitudinal to the rope, for which reason the rope retains its structure when bending. Individual fibers are thus oriented in the longitudinal direction of the rope. In this case the fibers are aligned with the force when the rope is pulled. Individual reinforcing fibers f are bound into a uniform force transmission part with the polymer matrix m. Thus, each force transmission part 15 is one solid elongated rodlike piece. The reinforcing fibers f are preferably long continuous fibers in the longitudinal direction of the rope 4,4', and the fibers f preferably continue for the distance of the whole length of the rope 4,4'. Preferably as many fibers f as possible, most preferably essentially all the fibers f of the force transmission part 15 are oriented in longitudinal direction of the rope. The reinforcing fibers f are in this case essentially untwisted in relation to each other. Thus the structure of the force transmission part can be made to continue the same as far as possible in terms of its cross-section for the whole length of the rope. The reinforcing fibers f are preferably distributed in the aforementioned force transmission part 15 as evenly as possible, so that the force transmission part 15 would be as homogeneous as possible in the transverse direction of the rope. An advantage of the structure presented is that the matrix m surrounding the reinforcing fibers f keeps the interpositioning of the reinforcing fibers f essentially unchanged. It equalizes with its slight elasticity the distribution of a force exerted on the fibers, reduces fiber-fiber contacts and internal wear of the rope, thus improving the service life of the rope. The reinforcing fibers being carbon fibers, a good tensile rigidity and a light structure and good thermal properties, among other things, are achieved. They possess good strength properties and rigidity properties with small cross sectional area, thus facilitating space efficiency of a roping with certain strength or rigidity requirements. They also tolerate high temperatures, thus reducing risk of ignition. Good thermal conductivity also assists the onward transfer of heat due to friction, among other things, and thus reduces the accumulation of heat in the parts of the rope. The composite matrix m, into which the individual fibers f are distributed as evenly as possible, is most preferably of epoxy resin, which has good adhesiveness to the reinforcements and which is strong to behave advantageously with carbon fiber. Alternatively, e.g. polyester or vinyl ester can be used. Alternatively some other materials could be used. FIG. 4 presents a partial cross-section of the surface structure of the force transmission part 15 as viewed in the longitudinal direction of the rope 4,4', presented inside the circle in the figure, according to which cross-section the reinforcing fibers f of the force transmission parts 15 are preferably organized in the polymer matrix m. FIG. 4 presents how the individual reinforcing fibers f are essentially evenly distributed in the polymer matrix m, which surrounds the fibers and which is fixed to the fibers f. The polymer matrix m fills the areas between individual reinforcing fibers f and binds essentially all the reinforcing fibers f that are inside the matrix m to each other as a uniform solid substance. In this case abrasive movement between the reinforcing fibers f and abrasive movement between the reinforcing fibers f and the matrix m are essentially prevented. A chemical bond exists between, preferably all, the individual reinforcing fibers f and the matrix m, one advantage of which is uniformity of the structure, among other things. To strengthen the chemical bond, there can be, but not necessarily, a coating (not presented) of the actual fibers between the reinforcing fibers and the polymer matrix m. The polymer matrix m is of the kind described elsewhere in this application and can thus comprise additives for fine-tuning the properties of the matrix as an addition to the base polymer. The polymer matrix m is preferably of a hard non-elastomer. The reinforcing fibers f being in the polymer matrix means here that in the invention the individual reinforcing fibers are bound to each other with a polymer matrix m e.g. in the manufacturing phase by embedding them together in the molten material of the polymer matrix. In this case the gaps of individual reinforcing fibers bound to each other with the polymer matrix comprise the polymer of the matrix. In this way a great number of reinforcing fibers bound to each other in the longitudinal direction of the rope are distributed in the polymer matrix. The reinforcing fibers are preferably distributed essentially evenly in the polymer matrix such that the force transmission part is as homogeneous as possible when viewed in the direction of the cross-section of the rope. In other words, the fiber density in the cross-section of the force transmission part does not therefore vary greatly. The reinforcing fibers f together with the matrix m form a uniform force transmission part, inside which abrasive relative movement does not occur when the rope is bent. The individual reinforcing fibers of the force transmission part 15 are mainly surrounded with polymer matrix m, but fiber-fiber contacts can occur in places because controlling the position of the fibers in relation to each other in their simultaneous impregnation with polymer is difficult, and on the other hand, perfect elimination of random fiber-fiber contacts is not necessary from the viewpoint of the functioning of the invention. If, however, it is desired to reduce their random occurrence, the individual reinforcing fibers f can be pre-coated such that a polymer coating is around them already before the binding of individual reinforcing fibers to each other. In the invention the individual reinforcing fibers of the force transmission part can comprise material of the polymer matrix around them such that the polymer matrix is immediately against the reinforcing fiber but alternatively a thin coating, e.g. a primer arranged on the surface of the reinforcing fiber in the manufacturing phase to improve chemical adhesion to the matrix material, can be in between. Individual reinforcing fibers are distributed evenly in the force transmission part 15 such that the gaps of individual reinforcing fibers f are filled with the polymer of the matrix m. Most preferably the majority, preferably essentially all of the gaps of the individual reinforcing fibers f in the force transmission part are filled with the polymer of the matrix. The matrix m of the force transmission part 15 is most preferably hard in its material properties. A hard matrix m helps to support the reinforcing fibers f, especially when the rope bends, preventing buckling of the reinforcing fibers f of the bent rope, because the hard material supports the fibers f. To reduce the buckling and to facilitate a small bending radius of the rope, among other things, it is therefore preferred that the polymer matrix is hard, and therefore preferably something other than an elastomer (an example of an elastomer: rubber) or something else that behaves very elastically or gives way. The most preferred materials are epoxy resin, polyester, phenolic plastic or vinyl ester. The polymer matrix is preferably so hard that its module of elasticity (E) is over 2 GPa, most preferably over 2.5 GPa. In this case the module of elasticity (E) is preferably in the range 2.5-10 GPa, most preferably in the range 2.5-3.5 GPa. Preferably over 50% of the surface area of the cross-section of the force transmission part is of the aforementioned reinforcing fiber, preferably such that 50%-80% is of the aforementioned reinforcing fiber, more preferably such that 55%-70% is of the aforementioned reinforcing fiber, and essentially all the remaining surface area is of polymer matrix. Most preferably such that approx. 60% of the surface area is of reinforcing fiber and approx. 40% is of matrix material (preferably epoxy). In this way a good longitudinal strength of the rope is achieved.

Figure 5:
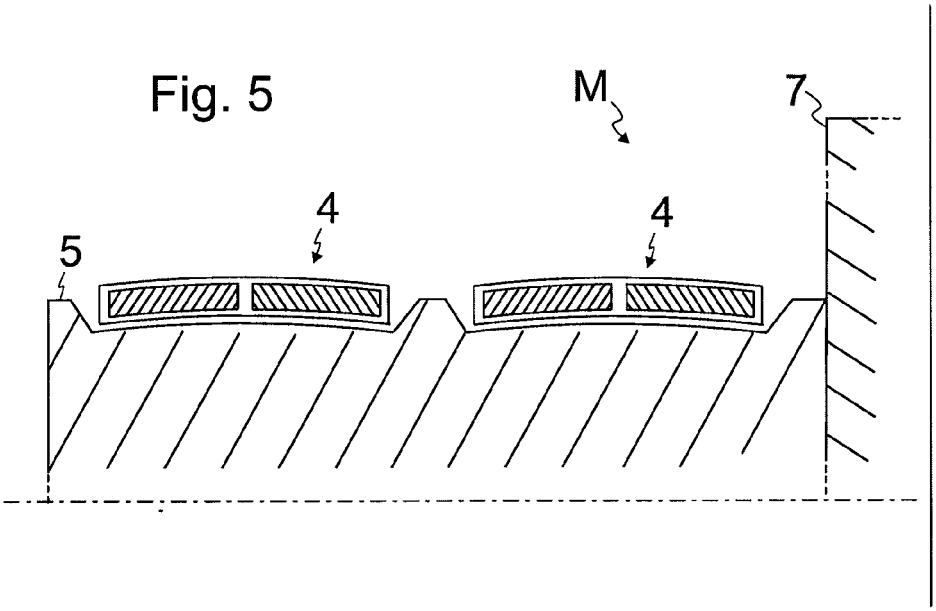
FIGS. 5 and 6 illustrate preferred alternative structures of the drive sheave and the rope.
Figure 6:
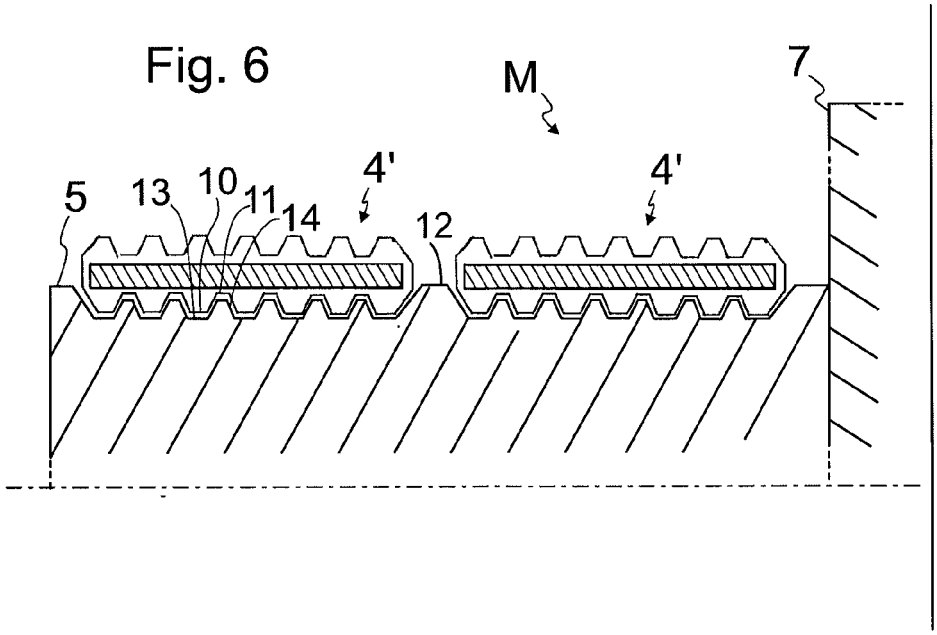

FIGS. 5 and 6 illustrate alternative preferred detailed surface structures for the drive sheave 5 and the rope 4,4'. The figures illustrate a vertical cross-section at the point of the axis of rotation of the drive sheave 5. The internal structure of the ropes of each of FIGS. 5 and 6 could be in any form that is explained elsewhere in the application.

In the embodiment of FIG. 5 two ropes 4 pass around the drive sheave 5 adjacent each other in width-direction of the rope 4 the wide sides of the ropes 4 against the drive sheave 5. In this case, the wide side is flat and without guide ribs or guide grooves and it is fitted to pass against a cambered circumference of the drive sheave 5. In this way traction can be based on friction contact between the drive sheave 5 and the rope and the rope is guided in its width direction with the cambered shape. The internal structures of the ropes could alternatively be as illustrated in FIG. 3*b*.

In the embodiment of FIG. 6 two ropes 4 pass around the drive sheave 5 adjacent each other in width-direction of the rope 4 the wide sides of the ropes 4 against the drive sheave 5. In this case, the wide side is contoured and provided with guide ribs 10 and guide grooves 11 oriented in the longitudinal direction of the rope 4', and said contoured side is fitted to pass against a contoured circumference 12 of the drive sheave 5 said contoured circumference 12 being provided with guide ribs 14 and guide grooves 13 so that said contoured circumference 12 forms a counterpart for said contoured sides of the ropes 4'. This provides the effect that the ropes 4' are guided very accurately in axial direction of the drive sheave 5. Thus, the wandering of the ropes is small which facilitates that small distances between adjacent ropes can be had very small as well as running clearances between the ropes and the stationary parts of the machinery M. Also, very small running clearance between the ropes and the guide rail 6 can be had in the embodiment where the drive sheave 5 is fixed to the guide rail 6. In this way very compact axial structure for the drive sheave 5 and the roping 3 is achieved. In particular, the rope comprises plurality of ribs 10 and the circumference of the drive sheave 5 comprises plurality of grooves 13 into which the ribs 10 of the rope extend. The layer p of the rope forms said ribs 10 grooves 11 of the rope. Each groove 11,13 and each rib 10,14 has opposite side faces facing the width direction of the rope (preferably in an angle inclined towards the side where the counterpart is located). The side faces of the ribs 10,14 are fitted between side faces of the grooves 11,13. The internal structures of the ropes could alternatively be as illustrated in FIG. 3*a*.

The counterweight 2 is in the illustrated embodiments positioned on the same side of the car as the drive sheave 5. The counterweight 2 could alternatively be positioned on the back side of the car (the side opposite the doorway). In that case, the ropes 4,4' on the second side of the drive sheave would be guided by additional diverting wheels to pass to the counterweight. The suspension need not be central, as the elevator could also be implemented in ruck-sack configuration. In that case, the ropes 4,4' would not cross the vertical projection of the car but would rise back up from the first diverting wheel on the same side of the car 1 where the drive sheave 5 is located.

The drive sheave 5 diameter is preferably from 250 mm to 350 mm (diameter of the rope contacting circumference).

The roping 3 and its ropes being as described, the drive sheave can be made very compact. The width of the rope receiving surface section as measured in the axial direction of the drive sheave can be made less than 80 mm, or even less.

In this application, the term force transmission part refers to the part that is elongated in the longitudinal direction of the rope 4,4', and which part is able to bear without breaking a significant part of the load exerted on the rope in question in the longitudinal direction of the rope. The aforementioned load causes tension on the force transmission part in the longitudinal direction of the rope, which tension can be transmitted inside the force transmission part in question all the way from the drive sheave 5 to elevator car 1, and from the drive sheave to the counterweight 2 respectively.

It is preferable, that the elevator comprises only said drive machine, as no other drive machines are needed. Respectively, the elevator comprises only said roping passing around a drive sheave, as no other ropings passing around a drive sheave are needed.

It is to be understood that the above description and the accompanying Figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. An elevator comprising:

a hoistway;

an elevator car and a counterweight vertically movable in the hoistway;

a drive machine comprising a drive sheave, the drive sheave having a diameter from 250 mm to 350 mm; and a roping comprising exactly two ropes between the elevator car and the counterweight and passing around the drive sheave and suspending the elevator car and the counterweight, wherein said ropes are belt-shaped and pass around the drive sheave adjacent each other in a width-direction of the ropes, such that the ropes lie against the drive sheave, wherein the drive sheave is positioned in a hoistway space that is between a hoistway wall and a vertical projection of the elevator car, said drive sheave having a rotation plane that is at least substantially parallel to the hoistway wall, wherein each rope comprises exactly one force transmission part for transmitting force in a longitudinal direction of the rope, each force transmission part being made of composite material comprising reinforcing fibers in a polymer matrix, and in that the reinforcing fibers are carbon fibers, and each force transmission part has a width larger than a thickness thereof as measured in the width-direction of the rope, wherein each rope has a width less than 80 mm, wherein the thickness of each force transmission part is from 0.8 mm to 1.5 mm as measured in a thickness direction of the rope, wherein a total width of the force transmission parts of the two ropes is from 40 mm to 60 mm, wherein the elevator comprises a car guide rail between the elevator car and the hoistway wall and the drive sheave is positioned between the hoistway wall and the guide rail, wherein each of said ropes has two contoured sides, each contoured side is provided with guide ribs and guide grooves oriented in the longitudinal direction of the rope, wherein one of said two contoured sides of each of the ropes is fitted to pass against a contoured circumference of the drive sheave, said contoured circumference being provided with guide ribs and guide grooves so that said contoured circumference forms a counterpart for said contoured sides of each of the ropes that is fitted to pass against the contoured circumference of the drive sheave, and wherein said contoured circumference includes a protrusion extending radially outwardly from the drive sheave to separate the ropes from one another.

2. The elevator according to claim 1, wherein a width/thickness ratio(s) of said force transmission part(s) is/are at least 8.

3. The elevator according to claim 1, wherein said ropes are connected on a first side of the drive sheave to the elevator car via a at least one diverting wheel mounted on the elevator car and on a second side of the drive sheave to the counterweight via a at least one diverting wheel mounted on the counterweight.

4. The elevator according to claim 1, wherein each of said ropes comprises exactly one of said force transmission parts.

5. The elevator according to the claim 4, wherein the width of the single force transmission part is from 20 mm to 30 mm.

6. The elevator according to claim 1, wherein the drive machine includes a motor and the drive sheave is an extension of a rotor of the motor of the drive machine.

7. The elevator according to claim 6, wherein the motor is a flat electric motor in its axial direction, its greatest axial dimensions being substantially smaller than its greatest radial dimensions.

8. The elevator according to claim 1, wherein the drive machine comprises an electric motor for rotating the drive sheave, and the motor is positioned in said hoistway space which is between the hoistway wall and the vertical projection of the elevator car, a plane of rotation of the motor being parallel to the plane of rotation of the drive sheave.

9. The elevator according to claim 1, wherein the drive sheave is fixed rotatably to the car guide rail.

10. The elevator according to claim 1, wherein each of said ropes has a wide and flat side without guide ribs or guide grooves fitted to pass against a cambered circumference of the drive sheave.

11. The elevator according to claim 1, wherein the force transmission part(s) of the rope cover(s) a majority of the width of the rope.

12. The elevator according to claim 1, wherein the contoured sides of each of the ropes are symmetric about the respective force transmission part(s).

13. An elevator comprising:

a hoistway;

an elevator car and a counterweight vertically movable in the hoistway;

a drive machine comprising a drive sheave, the drive sheave having a diameter from 250 mm to 350 mm; and a roping comprising exactly two belt-shaped ropes between the elevator car and the counterweight and passing around the drive sheave adjacent each other in a width-direction of the ropes, such that the ropes lie against the drive sheave and suspend the elevator car and the counterweight, wherein the drive sheave is positioned in a hoistway space which is between a hoistway wall and a vertical projection of the elevator car, said drive sheave having a rotation plane that is at least substantially parallel to the hoistway wall, wherein each rope comprises exactly one force transmission part for transmitting force in a longitudinal direction of the rope, which force transmission part is made of composite material comprising reinforcing fibers in a polymer matrix, and in that the reinforcing fibers are carbon fibers, and in that said one force transmission part has a width larger than a thickness thereof as measured in the width-direction of the ropes, wherein each rope has a width less than 80 mm, wherein the thickness of each force transmission part is from 0.8 mm to 1.5 mm as measured in a thickness direction of the ropes, wherein a total width of the force transmission parts of the two ropes is from 40 mm to 60 mm, wherein the elevator comprises a car guide rail between the elevator car and the hoistway wall and the drive sheave is positioned between the hoistway wall and the guide rail, wherein each of said ropes has two contoured sides, each contoured side is provided with guide ribs and guide grooves oriented in the longitudinal direction of the rope, wherein one of said two contoured sides of each of said ropes is fitted to pass against a contoured circumference of the drive sheave, said contoured circumference being provided with guide ribs and guide grooves so that said contoured circumference forms a counterpart for said contoured side of each of the ropes that is fitted to pass against the contoured circumference of the drive sheave, and wherein said contoured circumference includes a protrusion extending radially outwardly from the drive sheave to separate the ropes from one another.

14. The elevator according to claim 13, wherein the contoured sides of each of the ropes are symmetric about the respective force transmission part(s).

* * * * *